US010707590B2

(12) United States Patent
Crotti et al.

(10) Patent No.: US 10,707,590 B2
(45) Date of Patent: Jul. 7, 2020

(54) CLAMPS FOR MALE TERMINALS OF POWER SOURCES

(71) Applicant: MTA S.p.A., Codogno (LO) (IT)

(72) Inventors: Antonio Crotti, Crema (IT); Emanuele Zabaglio, Fombio (IT)

(73) Assignee: MTA S.P.A., Codogno (LO) (IT)

( * ) Notice: Subject to any disclaimer, the term of this patent is extended or adjusted under 35 U.S.C. 154(b) by 0 days.

(21) Appl. No.: 16/363,037

(22) Filed: Mar. 25, 2019

(65) Prior Publication Data

US 2019/0296456 A1 Sep. 26, 2019

(30) Foreign Application Priority Data

Mar. 26, 2018 (IT) ..... 102018000003963

(51) Int. Cl.
*H01R 4/40* (2006.01)
*H01R 13/641* (2006.01)
*H01R 11/28* (2006.01)

(52) U.S. Cl.
CPC ..... *H01R 4/40* (2013.01); *H01R 11/281* (2013.01); *H01R 13/641* (2013.01); *H01R 11/284* (2013.01); *H01R 11/289* (2013.01)

(58) Field of Classification Search
CPC ..... H01R 4/40
See application file for complete search history.

(56) References Cited

U.S. PATENT DOCUMENTS 1,808,648 A * 6/1931 Fisher ..... H01R 11/284 439/522
1,969,051 A * 8/1934 Thompson ..... H01R 11/282 439/522
2,052,081 A * 8/1936 Campbell ..... H01R 11/284 439/202
2,110,055 A * 3/1938 Richter ..... H01R 13/5219 439/277

(Continued)

FOREIGN PATENT DOCUMENTS

EP 0 809 327 A2 11/1997
EP 3 264 534 A1 1/2018

OTHER PUBLICATIONS

Italian Search Report and Written Opinion, search completed on Nov. 28, 2018, from corresponding Italian Application No. 102018000003963, 9 pages.

*Primary Examiner* — Ross N Gushi
(74) *Attorney, Agent, or Firm* — MH2 Technology Law Group LLP

(57) ABSTRACT

A clamp for a male terminal of a power source, the terminal including a frustoconical body projecting out of a base surface that is part of the source against which a greatest diameter of the terminal rests, may include: at least one ring-shaped first portion, with an open section of its circumference, the at least one first portion having a first diameter such that a predetermined radial clearance exists when the at least one first portion axially fits upon the frustoconical body, the at least one first portion also having two jaws which axially project out of the circumference of the at least (Continued)

one first portion, the jaws being in opposed, spaced-apart relationship; and a clamping device which acts on the jaws and is configured to move the first jaws toward each other to tighten the at least one first portion around the frustoconical body with elimination of the clearance.

20 Claims, 9 Drawing Sheets

(56) References Cited

U.S. PATENT DOCUMENTS 2,119,294 A * 5/1938 Schaefer ..... H01R 11/281 439/522
2,145,135 A * 1/1939 Ryalls ..... H01M 2/32 439/200
2,906,988 A * 9/1959 Stocking ..... H01R 11/284 439/522
3,568,139 A * 3/1971 Delzer ..... H01R 11/282 439/759
3,633,154 A * 1/1972 Glantz ..... H01R 4/70 439/202
3,790,920 A * 2/1974 Wening ..... H01R 11/284 439/522
3,867,007 A 2/1975 Wening
4,698,459 A * 10/1987 Drake ..... H01R 11/284 174/138 F
4,778,408 A * 10/1988 Morrison ..... H01R 11/28 439/522
4,920,018 A * 4/1990 Turner ..... H01M 2/32 429/65
5,021,305 A * 6/1991 Turner ..... H01M 2/32 429/65
5,169,338 A * 12/1992 Dewar ..... H01M 2/344 174/138 F
5,302,142 A * 4/1994 Tabata ..... H01R 11/283 439/762
5,302,143 A * 4/1994 Inoue ..... H01R 11/283 439/762
5,346,407 A * 9/1994 Hood ..... B60R 16/04 439/202
5,439,759 A * 8/1995 Lippert ..... H01M 2/32 174/138 F
5,445,907 A * 8/1995 Ito ..... H01R 11/283 429/178
5,454,741 A * 10/1995 Okada ..... H01R 11/283 439/762
5,486,434 A * 1/1996 Aoyama ..... H01R 11/283 429/121
5,492,780 A * 2/1996 Okada ..... H01R 11/283 429/121
5,503,642 A * 4/1996 Lippert ..... H01M 2/32 29/623.1
5,558,544 A * 9/1996 Okada ..... H01R 11/282 439/762
5,576,516 A * 11/1996 Kameyama ..... H01M 2/32 174/138 F
5,584,730 A * 12/1996 Tabata ..... H01R 11/282 439/762
5,645,448 A * 7/1997 Hill ..... H01H 85/205 439/522
5,733,152 A * 3/1998 Freitag ..... H01R 11/281 439/762
5,800,219 A * 9/1998 Siedlik ..... H01R 11/287 439/762
5,804,770 A * 9/1998 Tanaka ..... H01M 2/206 174/138 F
5,833,499 A * 11/1998 Gonzales ..... H01M 2/34 439/755
5,897,403 A * 4/1999 Kourimsky ..... H01R 11/283 439/761
5,902,695 A * 5/1999 Siedlik ..... H01M 2/32 429/181
6,152,785 A * 11/2000 Haller ..... H01R 11/283 439/766
6,153,329 A * 11/2000 Raschilla ..... H01M 2/344 429/65
6,225,000 B1 * 5/2001 Pavlik ..... H01M 2/34 429/175
6,512,177 B2 * 1/2003 Kosuge ..... H01R 11/284 174/135
6,517,390 B2 * 2/2003 Kim ..... H01R 11/282 439/754
6,817,908 B2 * 11/2004 Freitag ..... H01R 11/285 439/763
6,869,310 B2 * 3/2005 Fukuda ..... H01R 11/282 439/522
6,884,123 B2 * 4/2005 Kim ..... H01M 2/305 439/754
7,234,979 B2 * 6/2007 Fujii ..... H01R 11/283 439/754
7,695,326 B1 * 4/2010 Freitag ..... H01R 11/282 439/772
8,287,319 B2 * 10/2012 Falchetti ..... H01R 11/283 439/765
8,317,549 B2 * 11/2012 Falchetti ..... H01R 11/283 439/762
8,636,550 B2 * 1/2014 Onoda ..... H01R 13/447 439/762
9,384,929 B2 * 7/2016 Masuda ..... H01H 85/0241
9,425,018 B2 * 8/2016 Nohara ..... H01H 85/201
9,608,254 B1 * 3/2017 Freitag ..... H01M 2/206
9,705,122 B2 * 7/2017 Yamada ..... H01M 2/30
9,774,110 B1 * 9/2017 Ritchie ..... H01M 2/305
9,979,104 B2 * 5/2018 Falchetti ..... H01R 11/24
10,008,789 B1 * 6/2018 Krass ..... H01R 11/283
10,014,603 B2 * 7/2018 Onoda ..... H01R 13/58
10,181,659 B2 * 1/2019 Bock ..... H01R 4/305
10,205,255 B2 * 2/2019 Iwata ..... H01R 11/285
10,211,565 B2 * 2/2019 Trimborn ..... H01R 4/34
10,224,530 B2 * 3/2019 Tsukiyoshi ..... H01M 2/30
10,269,522 B2 * 4/2019 Kitano ..... H01H 85/0241
10,305,082 B2 * 5/2019 Matsumoto ..... H01M 2/30
10,347,878 B2 * 7/2019 Tsukiyoshi ..... H01M 2/30
10,355,263 B2 * 7/2019 Tsukiyoshi ..... H01M 2/30
10,374,339 B2 * 8/2019 Nobukuni ..... H01R 11/283
10,381,752 B2 * 8/2019 Kaehny ..... H01R 13/447
2001/0024909 A1 * 9/2001 Wakata ..... H01R 11/283 439/680
2006/0003627 A1 * 1/2006 Freitag ..... H01R 11/283 439/504
2007/0264883 A1 * 11/2007 Freitag ..... H01R 11/281 439/764
2011/0143595 A1 * 6/2011 Facco ..... H01R 13/187 439/625
2013/0027174 A1 * 1/2013 Masuda ..... H01H 85/0241 337/142
2013/0071728 A1 * 3/2013 Shibanuma ..... H01M 2/0404 429/179
2015/0140872 A1 * 5/2015 Orange ..... H01R 11/282 439/762
2015/0180143 A1 * 6/2015 Iwata ..... H01R 11/285 439/754
2016/0126529 A1 * 5/2016 Matsumoto ..... H01R 11/281 429/121
2016/0126530 A1 * 5/2016 Kato ..... H01M 2/305 429/121
2016/0196947 A1 * 7/2016 Matsumoto ..... H01H 85/20 337/207
2017/0077626 A1 * 3/2017 Yamada ..... H01M 2/305
2017/0278662 A1 * 9/2017 Kitano ..... H01H 85/0241
2017/0345601 A1 * 11/2017 Kitano ..... H01H 85/0241
2018/0076436 A1 * 3/2018 Sasaki ..... H01M 2/30
2018/0226627 A1 * 8/2018 Shiohama ..... H01R 4/305
2019/0131726 A1 * 5/2019 Krass ..... H01R 11/283
2019/0296456 A1 * 9/2019 Crotti ..... H01R 11/281

* cited by examiner

CLAMPS FOR MALE TERMINALS OF POWER SOURCES

CROSS-REFERENCE TO RELATED APPLICATION(S)

This application claims priority under 35 U.S.C. § 119 from Italian Patent Application No. 102018000003963, filed on Mar. 26, 2018, in the Italian Patent and Trademark Office ("IPTO"), the entire contents of which are incorporated herein by reference.

TECHNICAL FIELD

The present invention relates to a clamp for connecting a power consuming unit to a male terminal of a power source, particularly to the male terminal of a battery preferably for automotive use.

As used herein, the term male terminal is intended to designate a frustoconical body projecting out of a base surface that is part of the source against which the frustoconical body rests with its greatest diameter, whereas the free end has the smallest diameter.

BACKGROUND ART

Clamps for establishing such connection are known in the art and are conventionally attached to one end of the power cord of the power consuming units to be connected to the power source.

They comprise at least one ring-shaped portion made of an electrically conductive material whose circumference is open at one section thereof. The ring-shaped portion is adapted to be axially fitted to the male terminal, with a predetermined radial clearance, and clamped thereto until it creates a proper and stable electrical contact between the outer surface of the terminal and the inner surface of the ring. Clamping is obtained by screw mechanisms. The latter act on two opposed and spaced-apart jaws, which radially project out of the circumference of the ring-shaped portion of the clamp and are placed at the ends of the open circumference section, draw them toward each other and hence clamp the ring-shaped portion around the body of the male terminal by eliminating the radial clearance. This will prevent accidental axial removal of the clamp and provide proper constant power supply to the power consuming units.

Conventionally, the ring-shaped portion of the clamp is manually clamped by an operator, who acts on the screw mechanism when said ring-shaped portion is entirely axially fitted on the male terminal, parallel to the base of the source from which the frustoconical body of the terminal projects.

In order to prevent the ring-shaped portion of the clamp from being clamped when said ring-shaped portion has not yet reached the proper axial position on the frustoconical body of the male terminal, i.e. when the ring-shaped portion is not yet proximate and parallel to the base surface from which the frustoconical body stands up, the clamps are known to be equipped with safety devices that allow proper identification of the position in which clamping has to be made.

This will prevent shocks or vibrations of the source from loosening the clamp and breaking the connection to the power consuming units.

A known type of safety device, as disclosed in Patent Application Publication EP 3 264 534, comprises a plate-like element, which is also made of an electrically conductive material, and has a circular opening with a diameter greater than the greatest diameter of the frustoconical body of the male terminal, connected to the ring-shaped portion of the clamp. According to the embodiment as described in the aforementioned patent application, the plate-like element is hinged to the outer edge of the ring-shaped portion of the clamp in a position opposite to the position in which the clamping jaws are located, on the side from which the clamp is to be fitted onto the male terminal. Said plate-like element is held in an angularly displaced position relative to the plane of the opening of the ring-shaped portion, by elastic means operating between such ring-shaped portion and the plate-like element.

When the clamp is axially fitted onto the frustoconical body of the male terminal, said plate-like element is the first to reach a position proximate and parallel to the base surface from which the male terminal stands up and keeps the ring-shaped portion lifted and tilted relative to the axis of the frustoconical body of terminal, thereby indicating that the position of the ring-shaped portion is not a correct clamping position.

According to the aforementioned prior art, the plate-like element is equipped with screw members for clamping the ring-shaped portion of the clamp but these members only exert their clamping action on the jaws of the ring-shaped portion of the clamp by overcoming the action of the interposed elastic means, after angularly displacing the ring-shaped portion relative to the plate-like element to a position parallel thereto. Then, since the ring-shaped portion is also adjacent and parallel to the base surface of the source from which the male terminal stands up, the position is deemed to be the correct clamping position for the clamp.

A different known technology to determine the correct position of a clamp before clamping it on a male terminal, is disclosed in U.S. Pat. No. 5,302,143.

PRIOR ART PROBLEM

While the known technical solutions that have been used to determine the correct clamping position of the clamp on the male terminal may be deemed to be effective in terms of stable mechanical connection, a drawback was nevertheless found in practice, due to the electrical behavior of the clamp components which, as mentioned above are made of an electrically conductive material.

It was found that, when fitting the clamp onto the male terminal, when the ring-shaped portion has not yet reached the correct clamping position, temporary electrical contacts may occur between the plate-like element, indicating the correct position, and the male terminal on which it is fitted, which contacts are transferred to the ring-shaped portion and from the latter to the power consuming units, thereby exciting them even temporarily.

As a result of such excitation of the power consuming units, the assembling operator may believe that the clamp has been properly positioned, and may thus decide to carry out the final clamping operation, when the correct position has not been reached yet.

With time, especially in automotive applications, this may cause the clamp to be loosened from the frustoconical body of the male terminal and cause unexpected power failures of the power consuming units of the vehicle.

SUMMARY OF THE INVENTION

The object of the present invention is to provide a structure of a clamp for male terminals of power sources that can obviate the above discussed drawback of prior art clamps.

This and other objects, as better explained hereafter, are fulfilled by a structure of a clamp for male terminals of a power source, particularly a battery for automotive use that, according to the invention is characterized as set forth in claim 1 below.

BRIEF DESCRIPTION OF THE DRAWINGS

The invention will be now described in greater detail with reference to certain embodiments thereof, given by way of illustration and without limitation, and shown in the annexed drawings in which.

DETAILED DESCRIPTION

Figure 1:
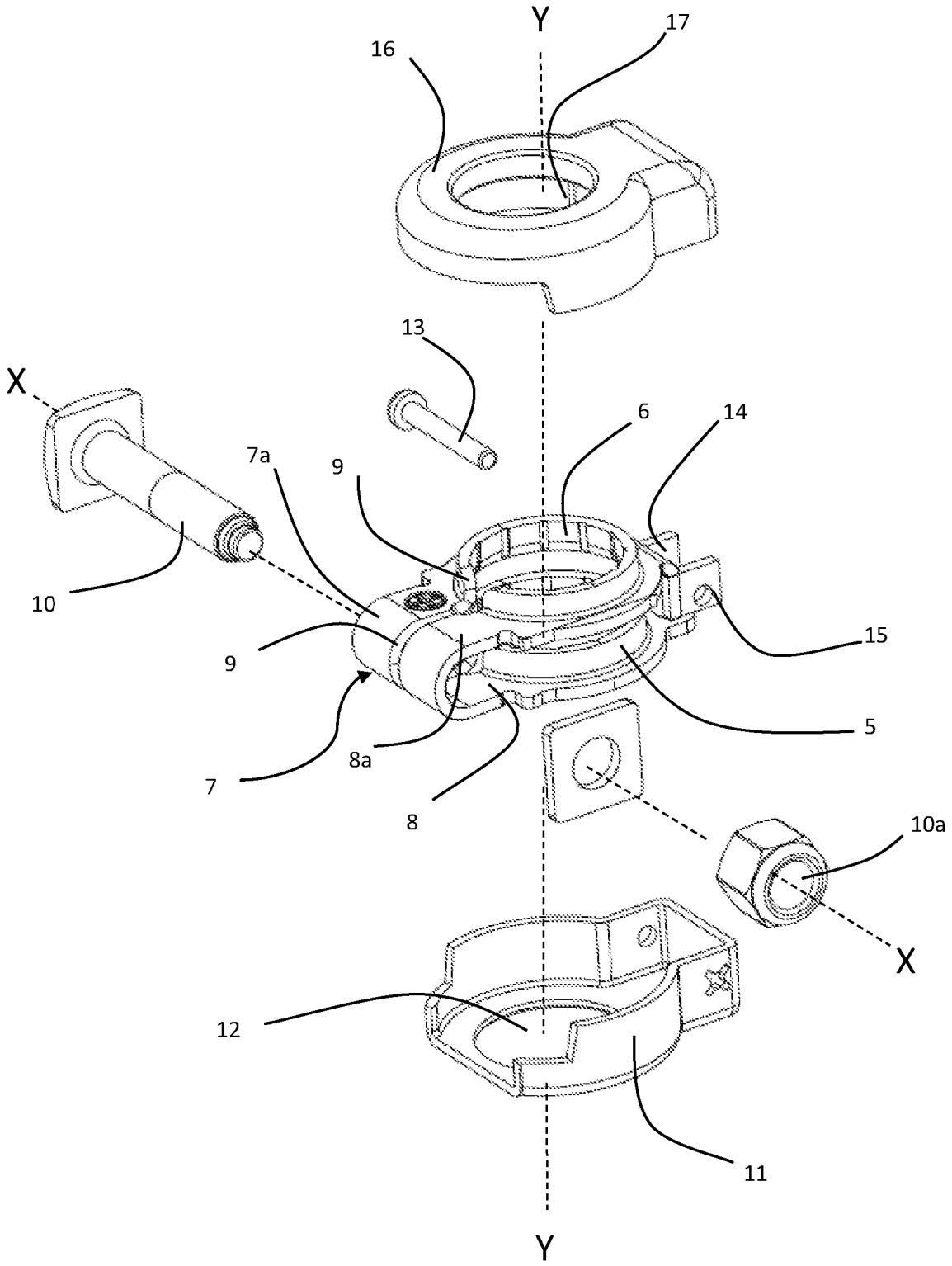
FIG. 1 shows an exploded perspective view of a first embodiment of the clamp of the invention.
Figure 2:
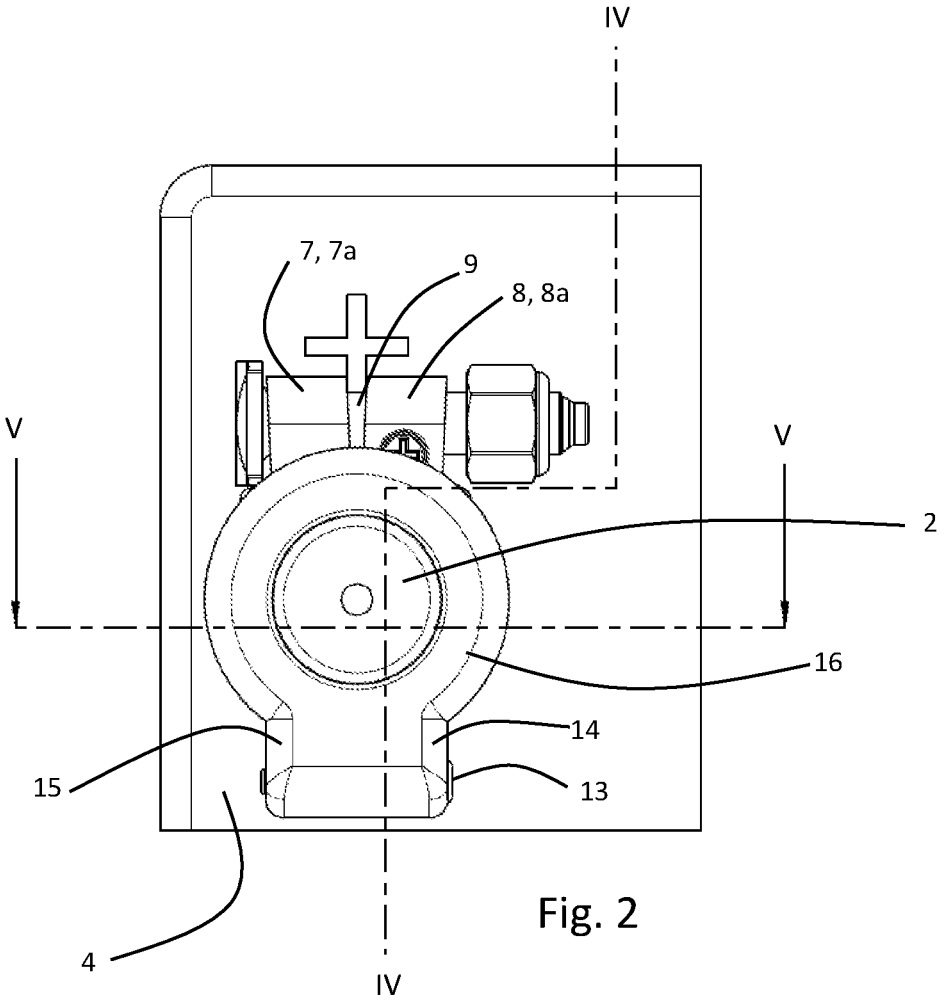
FIG. 2 shows a plan view of the clamp of FIG. 1 in an unclamped state.
Figure 3:
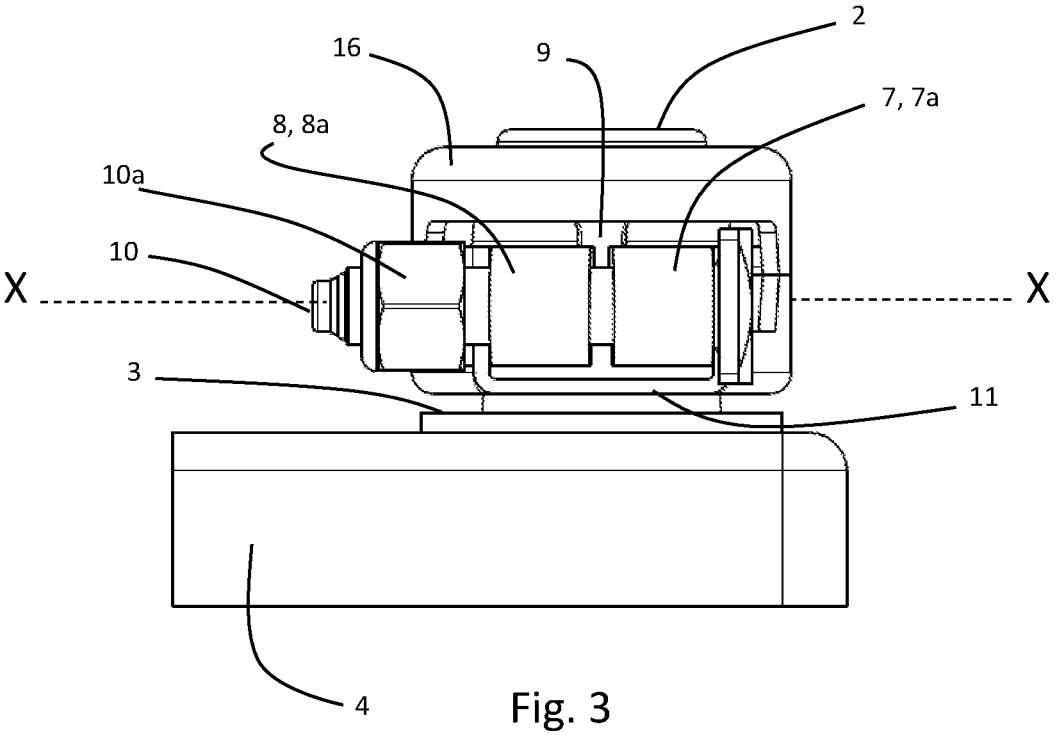
FIG. 3 shows a front view of the clamp of FIG. 2.

Referring to the above figures and particularly to FIGS. 1 to 8, which are associated with a first embodiment of the clamp of the invention, the latter is generally referenced 1, whereas the male terminal is referenced 2.

As is known in the art, this male terminal has a frustoconical shape whose greatest diameter D is proximate to a base surface 3 that is part of a power source 4, particularly of a battery for automotive use.

The smallest diameter of the frustoconical male terminal 2 is referenced d in the annexed drawings, whereas S designates the peripheral surface of the terminal between the smallest diameter d and the greatest diameter D.

The frustoconical body of terminal extends upwards from the base surface 3 of the source 4 along an axis that, in this particular field, is indicated as a Y axis of the three X, Y, Z Cartesian axes.

In the embodiment of FIGS. 1 to 8, the clamp 1 comprises at least one first and one second ring-shaped portions, referenced 5 and 6 respectively, which have respective jaws 7 and 8, 7*a* and 8*a*, radially projecting out of their circumference and located at the ends of their respective open sections 9 of the circumference.

Figure 4:
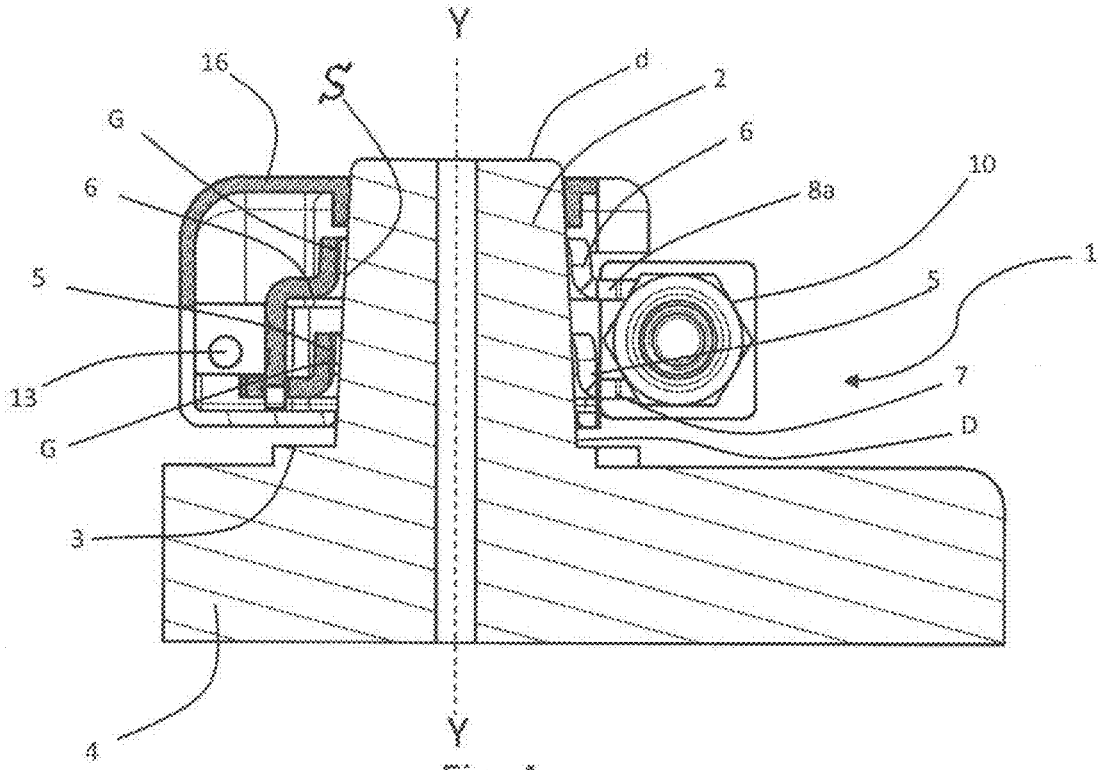
FIG. 4 shows a sectional view of the clamp as taken along line IV-IV of FIG. 2, before clamping.
Figure 5:
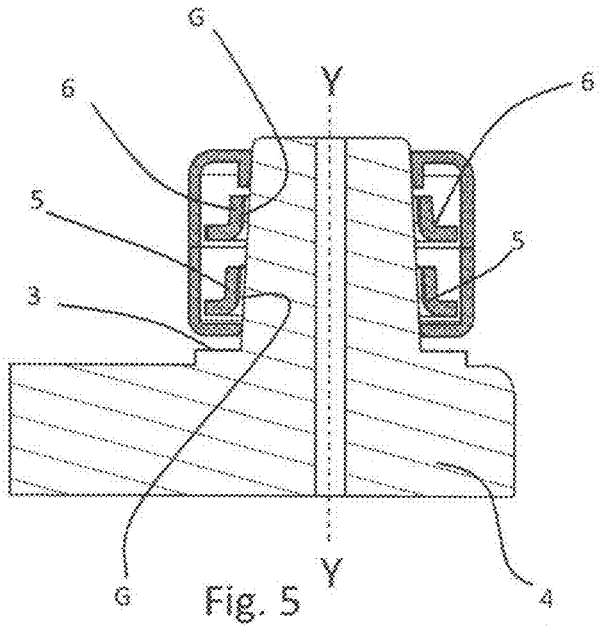
FIG. 5 is a sectional view of the clamp as taken along line V-V of FIG. 2, before clamping.
Figure 6:
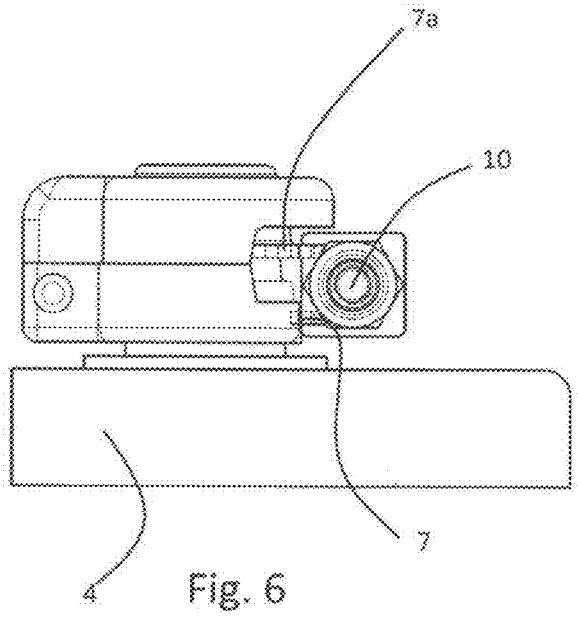
FIG. 6 shows a side view of the clamp of FIG. 2.

Said first and second ring-shaped portions 5 and 6 of the clamp 1 have such a diameter as to have a predetermined radial clearance G when they axially fit on the frustoconical body 2 of the terminal, as shown in the sections of FIGS. 4 and 5.

Said jaws 7, 8, 7*a* and 8*a*, are in opposed, spaced-apart relationship, when the clamp is in the unclamped state to allow it to fit onto the male terminal.

Also, as shown in FIG. 1, they may be interconnected such that the two ring-shaped portions 5 and 6 will be also connected.

Figure 7:
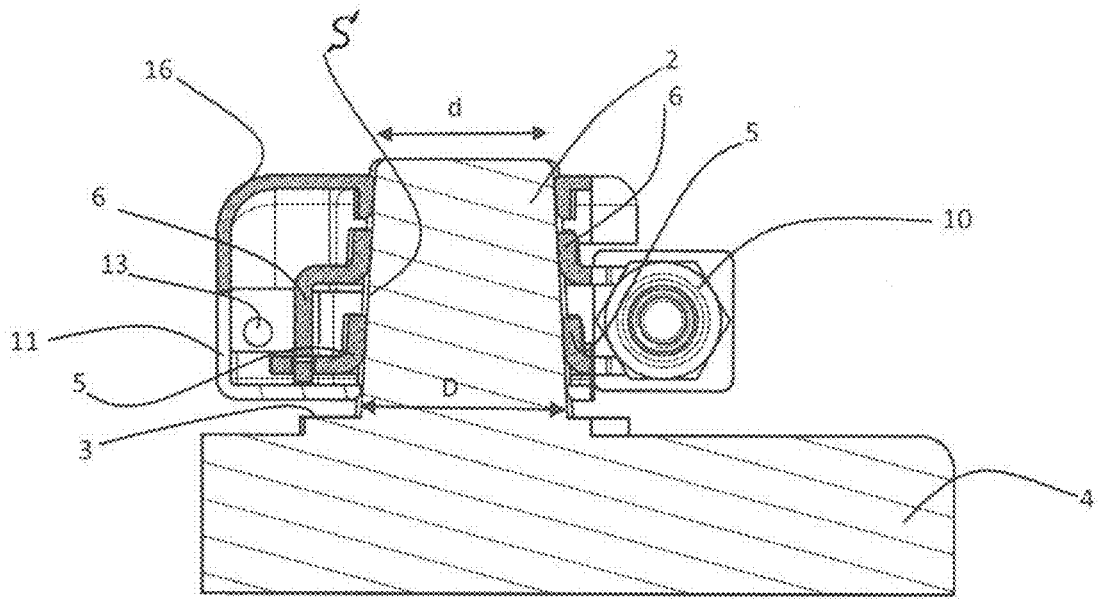
FIG. 7 shows a sectional view of the clamp like that of FIG. 4, in a clamped state.
Figure 8:
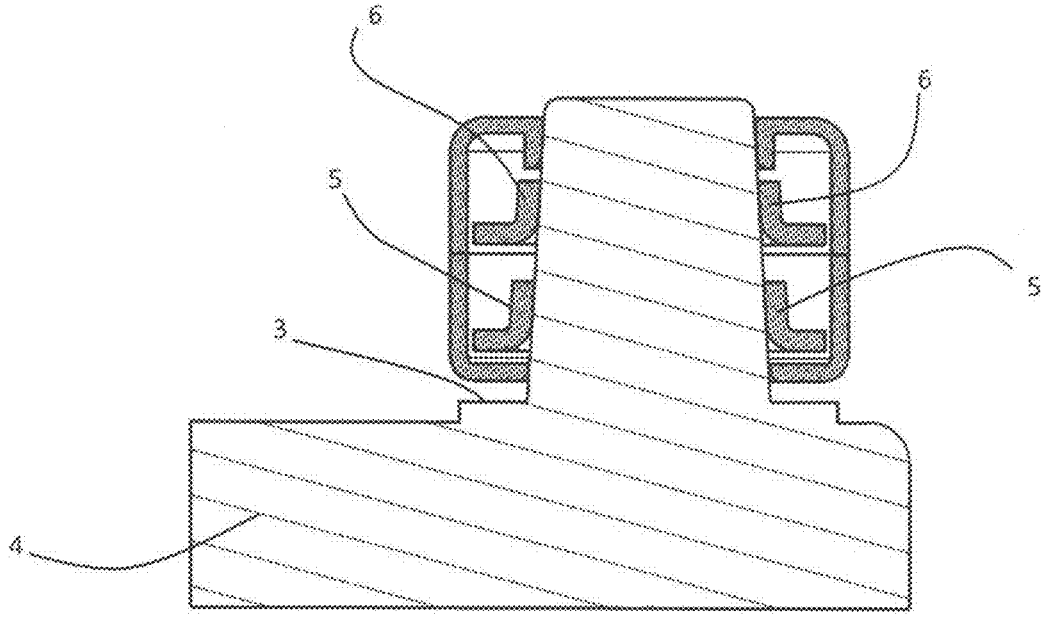
FIG. 8 shows a sectional view of the clamp like that of FIG. 5, in a clamped state.
Figure 9:
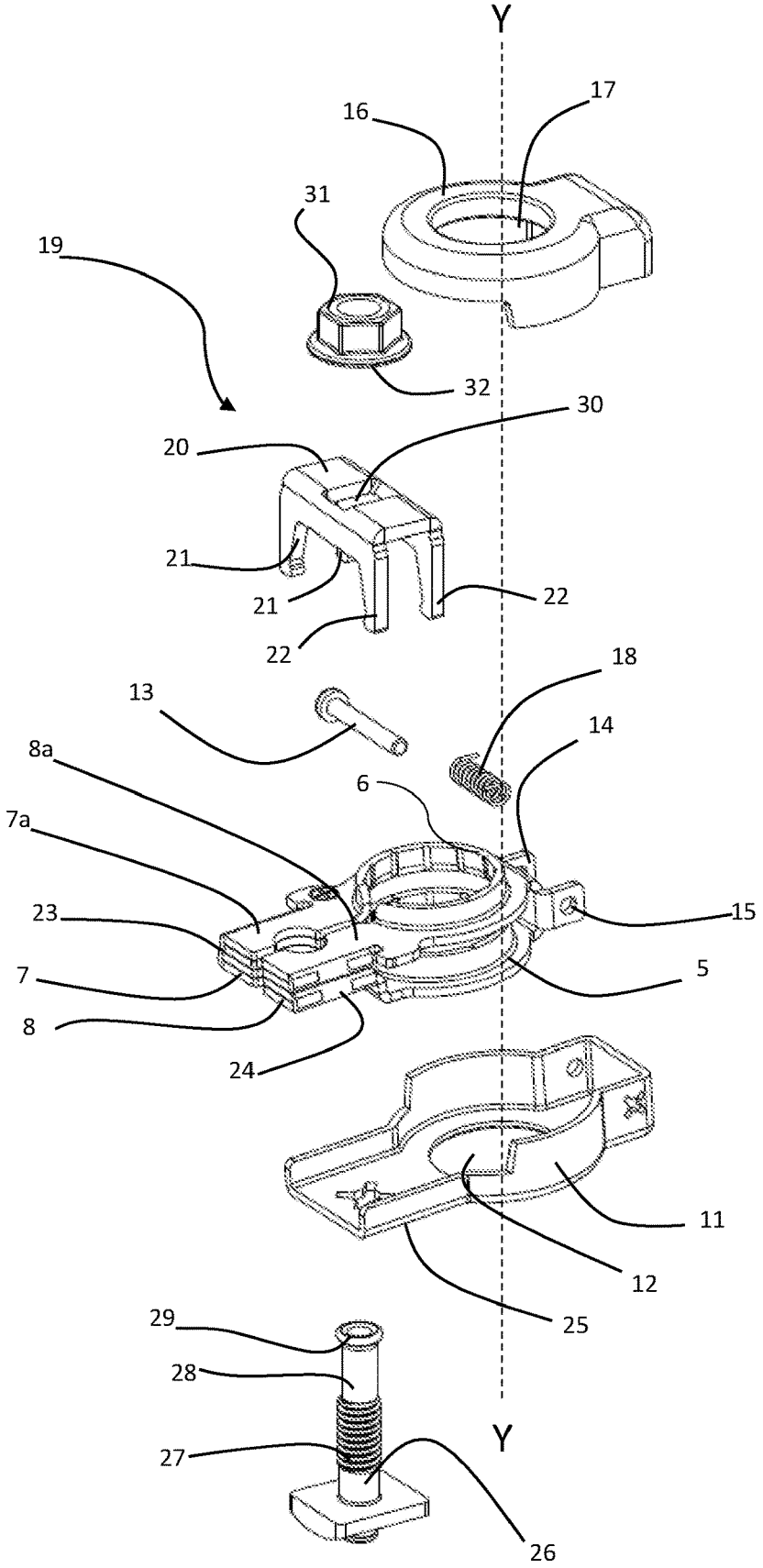
FIG. 9 shows an exploded perspective view of a second embodiment of the clamp of the invention.
Figure 10:
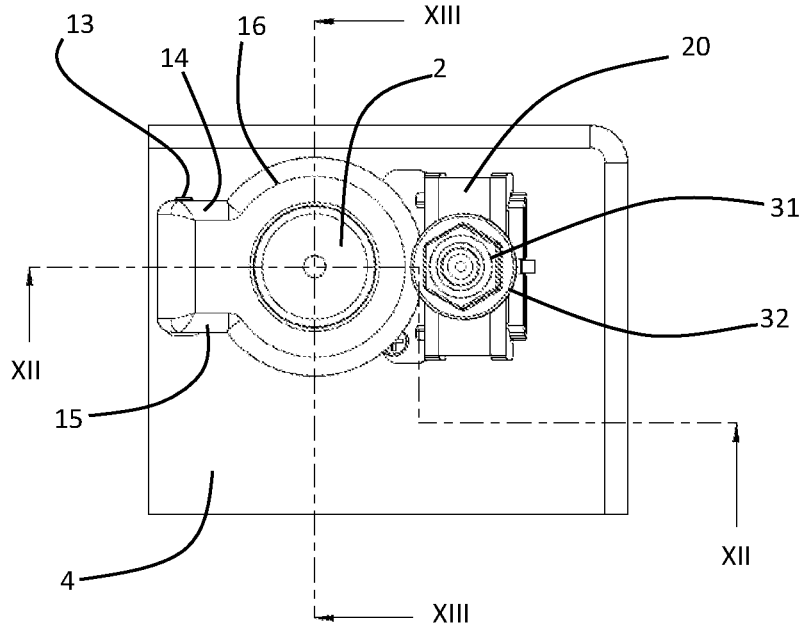
FIG. 10 shows a plan view of the clamp of FIG. 9 in an unclamped state.
Figure 11:
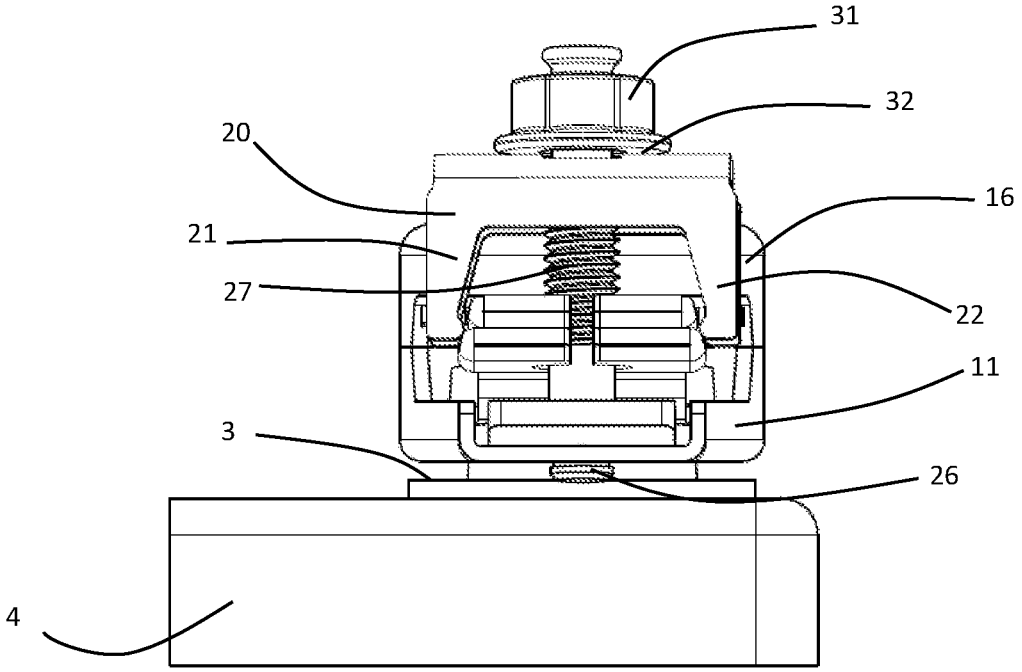
FIG. 11 shows a front view of the clamp of FIG. 10.
Figure 12:
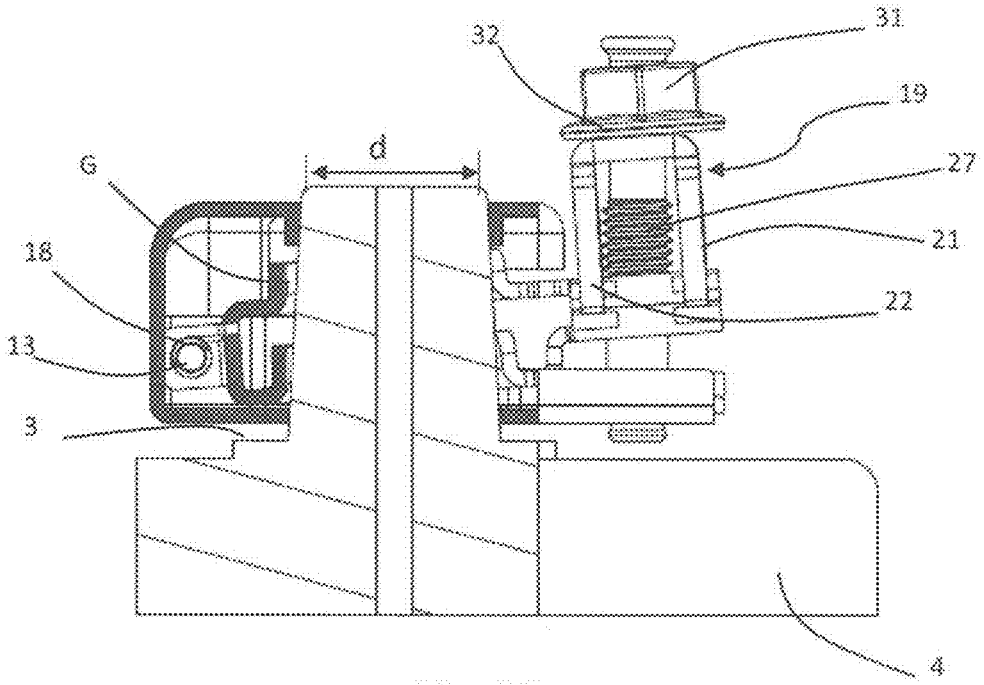
FIG. 12 is a sectional view of the clamp as taken along line XII-XII of FIG. 10, before clamping.
Figure 13:
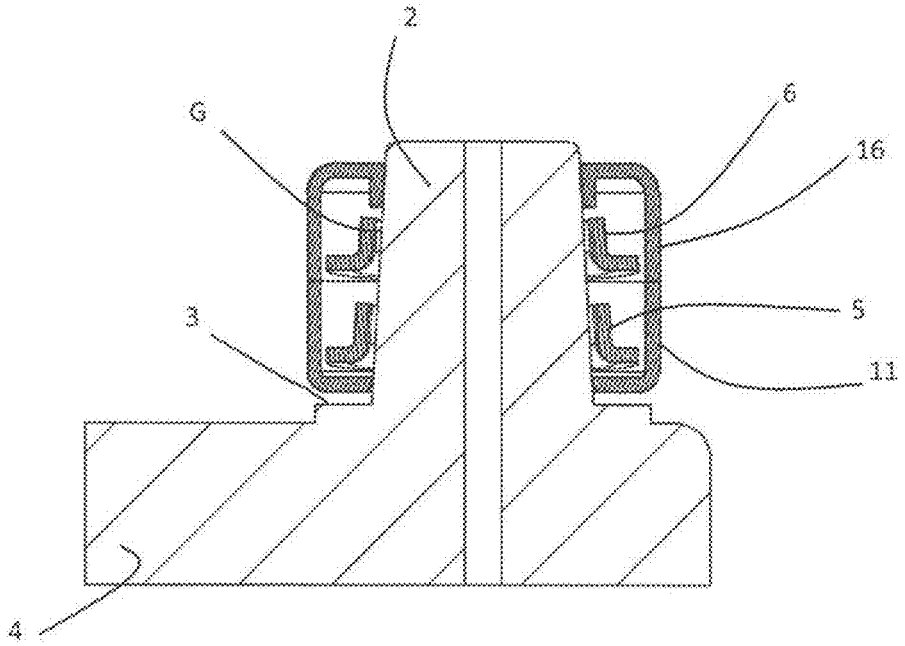
FIG. 13 is a sectional view of the clamp as taken along line XIII-XIII of FIG. 2, before clamping.
Figure 14:
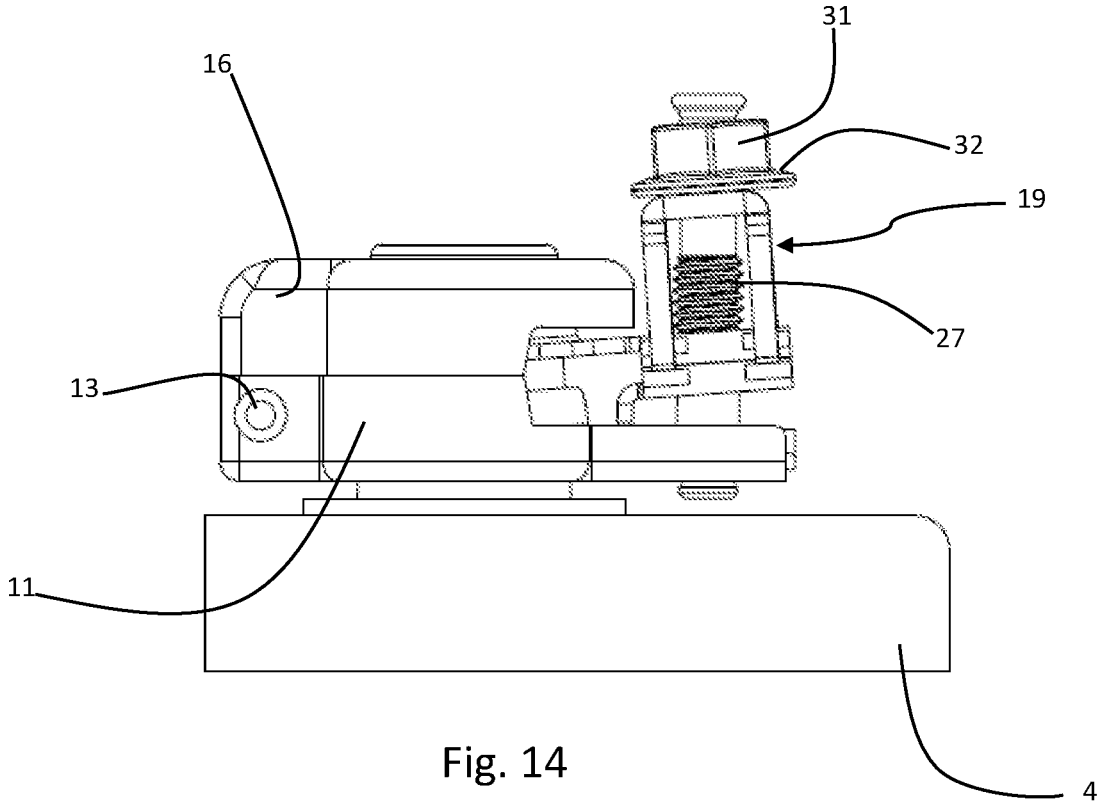
FIG. 14 shows a side view of the clamp of FIG. 10.
Figure 15:
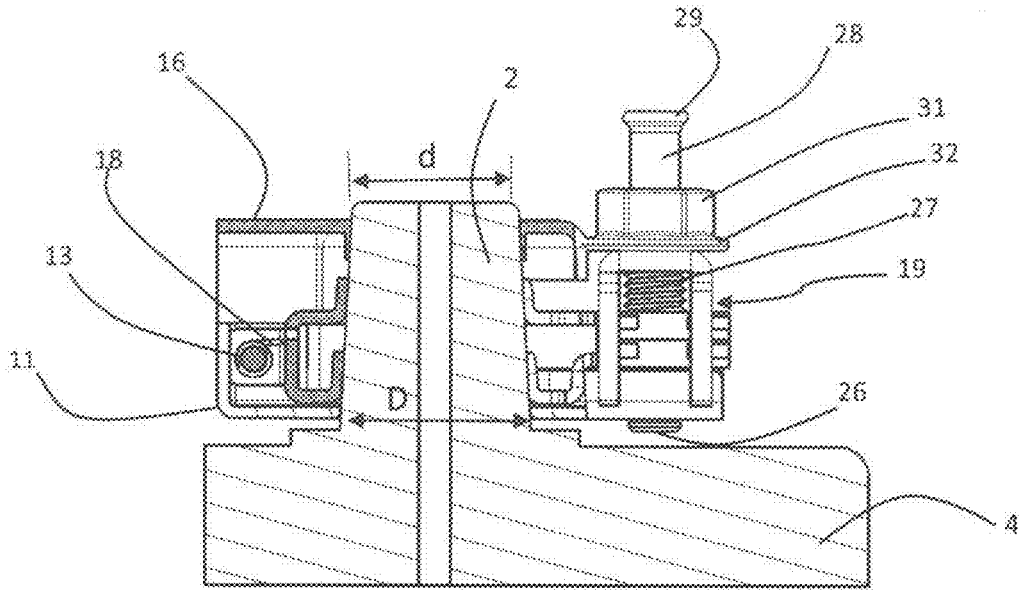
FIG. 15 shows a sectional view of the clamp like that of FIG. 12, in a clamped state.
Figure 16:
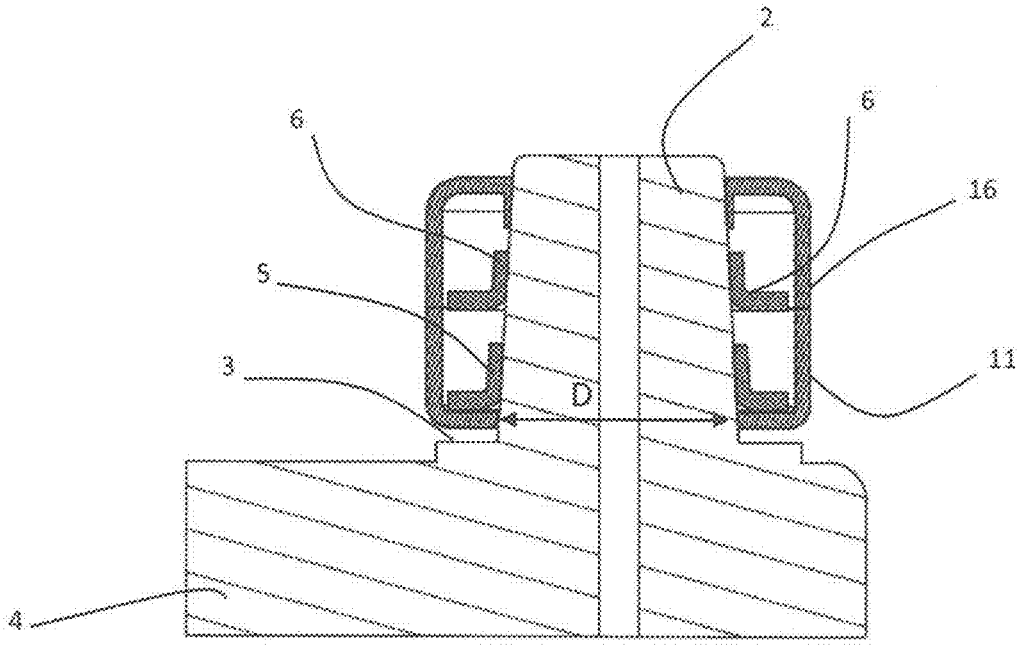
FIG. 16 shows a sectional view of the clamp like that of FIG. 13, in a clamped state.

The clamp also includes a conventional screw 10 and nut 10*a* device, which acts on the jaws 7, 8, 7*a*, 8*a*, to cause them to move toward each other, thereby clamping the ring-shaped portions 5 and 6 around the frustoconical body 2 of the male terminal, by eliminating the radial clearance G, as shown in the cross sections of FIGS. 7 and 8.

Thus, the clamping device 10, 10*a* acts on the jaws of the ring-shaped portions in the direction of the axis X perpendicular to the axis Y along which the male terminal extends.

In order to determine the correct axial position of the clamp 1 on the frustoconical body 2 in which the ring-shaped portions 5 and 6 are to be clamped, the terminal 1 also comprises a first plate-like element, referenced 11, associated with said first ring-shaped portion 5 of the clamp on the side in which it is inserted onto the male terminal.

According to the invention, said first plate-like element 11 is made of an electrically non-conductive material and has a through hole 12 whose diameter is adapted to create a radial interference with the greatest diameter D of the frustoconical body 2 proximate to said base surface 3 from which it stands up, when the clamp is fitted on the male terminal 2.

According to the embodiment of FIGS. 1 to 8, said first plate-like element 11 made of an electrically non-conductive material, is hinged to said first ring-shaped portion 5 of the terminal. In more detail, the first plate-like element 11 is connected to the first ring-shaped portion 5 via a connection that comprises a rod 13, placed parallel to the axis X, which engages with lugs 14 and 15 that radially project out of the first ring-shaped portion 5 on the side opposite to the side from which the jaws project.

In this embodiment, when the clamp 1 is fitted onto the male terminal, the plate-like element 11 is the first to reach the end of the axial stroke on the frustoconical body and, due to the interference between the diameter of the opening 12 and the greatest diameter D of the frustoconical body, it stops in a position substantially adjacent and parallel to the base surface 3 of the source 4.

The fact that the first ring-shaped portion 5 is hinged to said first plate-like element 11, for example by means of the rod 13 and the lugs 14 and 15, determines the correct axial position of the clamp on the male terminal, in which the ring-shaped portions 5 and 6 are to be clamped and provide power supply to the power consuming unit connected to the source 4.

According to an alternative version of the clamp, not shown, said plate-like element 11 may be not hinged, but connected to the ring-shaped portions 5 and 6 of the clamp in a fixed manner or, according to a further variant, also not shown, in a displaceable manner, to be displaced relative to the ring-shaped portions 5 and 6 along the axis Y of the frustoconical body.

According to the embodiment of the invention as shown in FIGS. 1 to 8 of the accompanying drawings, the clamp may comprise a second plate-like element 16 having a respective opening 17, which is associated with said ring-shaped portions 5 and 6 of the clamp 1, and is placed on the side opposite to the side in which the clamp 1 is inserted onto the male terminal 2, said second plate-like element being also made of an electrically non-conductive material. According to the embodiment of FIGS. 9 to 16, the screw and nut device, referenced 10 and 10*a*, for clamping the ring-shaped portions 5 and 6, which operates along a direction X perpendicular to the axis Y of the clamp in the embodiment of FIGS. 1 to 8, is replaced by a conventional safety mechanism that only enables clamping, i.e. the movement of the jaws of the ring-shaped portions toward each other, when at least the first ring-shaped portion 5 or both ring-shaped portions 5 and 6, are placed against the first plate-like element 11, once the latter has reached a position proximate to the base 3, and its opening 12 has come to interference with the greatest diameter D of the frustoconical body 2 of the terminal.

For this purpose, the safety mechanism comprises an elastic member 18 (e.g., a helical spring), reacting between said first plate-like element 11 and the ring-shaped portion 5, and adapted to maintain a predetermined angular gap between the ring-shaped portion and the plate-like element 11, around the rod 13.

In addition, said safety mechanism includes a clevis 19 having a transverse surface 20 and pairs of legs 21 and 22 with mutually facing inclined surfaces, extending therefrom.

The clevis 19 is placed above the pairs of jaws 7 and 8 with the inclined surfaces of its legs engaged with the sides 23 and 24 of the jaws.

A rod 26, having a threaded section 27 followed by an unthreaded section 28 and terminating with a collar 29, is fixed to the plate-like element 11. The rod 26 engages with the clevis 19 by extending through the opening 30 of the surface 20.

A nut 31 is mounted to the unthreaded section 28, between the collar 29 and the underlying threaded section 27, and engages by its flange-like underside, having a greater diameter than the opening 30, with the surface 20 of the clevis 19 around the opening 30.

The nut 31 may then engage with the threaded section 27 of the rod 26 and exert a clamping action on the clamp, only when the threaded portion approaches and projects out of the transverse surface 20, which only occurs when the operator straightens the tilt of the ring-shaped portion 5 relative to the plate like element 11, manually or using a (manual, electric, pneumatic, etc.) tool.

Here clamping takes place by tightening the nut 31 in a direction parallel to the axis Y of the clamp.

According to a further different embodiment of the clamp, the elastic member that acts between the plate-like element 11 and the ring-shaped portions 5 and 6, may be also provided in the clamp structure as shown in FIGS. 1 to 8, coaxial with the rod 13 of such structure.

In the embodiments as described above with reference to the drawings, the provision of a plate-like element 11 made of an electrically non-conductive material and of a diametrical dimension of the hole 12 providing interference with the greatest diameter D of the frustoconical body of the terminal when placing the clamp on the terminal, eliminates the risk that temporary electrical contacts may occur between the terminal and the clamp and that power consuming units may be excited when the correct position of the clamp on the terminal has not been reached yet.

Although not shown, at least one of the ring-shaped portions 5 and 6 of the clamp is intended to be connected to the end of the power cord that that connects said source 4 to a power consuming unit.

In detail, the clamp 1 comprises a conductive basement (not shown) protruding from the first ring-shaped portion 5. The basement is arranged substantially perpendicular to the direction of the axis Y along which the male terminal extends. The basement and the first ring portion 5 may be formed integrally to each other.

Moreover, the clamp 1 comprises a conductive connecting screw (not shown) fixed to the basement and protruding from the basement. Preferably, the connecting screw protrudes from the basement at least along the direction of the axis Y along which the male terminal extends.

Complementarily, the aforementioned end of the power cord comprises a conductive eyelet insertable upon the connecting screw.

Concerning the electrically non-conductive material that is used to form the plate-like elements 11 and 16, it is a plastic material.

The invention claimed is:

1. A clamp for a male terminal of a power source, the male terminal consisting of a frustoconical body projecting out of a base surface that is part of the power source against which a greatest diameter of the male terminal rests, the clamp comprising:

at least one ring-shaped first portion, with an open section of its circumference, the at least one ring-shaped first portion having a first diameter such that a predetermined radial clearance exists when the at least one ring-shaped first portion axially fits upon the frustoconical body, the at least one ring-shaped first portion also having two first jaws which axially project out of the circumference of the at least one ring-shaped first portion and are located at ends of the open section of the circumference of the at least one ring-shaped first portion, the first jaws being in opposed, spaced-apart relationship;

a clamping device which acts on the first jaws and is configured to move the first jaws toward each other to tighten the at least one ring-shaped first portion around the frustoconical body of the male terminal with elimination of the predetermined radial clearance; and at least one first element hinged to the at least one ring-shaped first portion of the clamp on a side from which the at least one first element is inserted upon the frustoconical body of the male terminal;

wherein the at least one first element is made of electrically non-conductive material and has a through-hole with a second diameter such that, when the clamp is fitted upon the male terminal, the through-hole establishes radial interference with the frustoconical body of the male terminal at the greatest diameter of the male terminal proximate to the base surface from which the male terminal projects, and wherein the at least one first element is connected to the at least one ring-shaped first portion of the clamp using a connection that comprises a rod, which engages with lugs that radially project out of the at least one ring-shaped first portion on a side opposite to a side from which the first jaws project.

2. The clamp of claim 1, wherein the clamping device acts on the first jaws of the at least one ring-shaped first portion in a direction of a first axis perpendicular to a direction of a second axis along which the male terminal extends, and wherein the rod is placed parallel to the first axis.

3. The clamp of claim 1, wherein the at least one first element, made of the electrically non-conductive material, is connected to the at least one ring-shaped first portion of the clamp such that the at least one first element is angularly movable relative to the at least one ring-shaped first portion.

4. The clamp of claim 1, further comprising:

a second element, associated with said first the at least one ring-shaped first portion of the clamp, on a side of the at least one ring-shaped first portion opposite to a side from which the second element is inserted onto the frustoconical body of the male terminal;

wherein the second element is made of electrically non-conductive material.

5. A clamp for a male terminal of a power source, the male terminal consisting of a frustoconical body projecting out of a base surface that is part of the power source against which a greatest diameter of the male terminal rests, the clamp comprising:

at least one ring-shaped first portion, with an open section of its circumference, the at least one ring-shaped first portion having a first diameter such that a predetermined radial clearance exists when the at least one ring-shaped first portion axially fits upon the frustoconical body, the at least one ring-shaped first portion also having two first jaws which axially project out of the circumference of the at least one ring-shaped first portion and are located at ends of the open section of the circumference of the at least one ring-shaped first portion, the first jaws being in opposed, spaced-apart relationship;

a clamping device which acts on the first jaws and is configured to move the first jaws toward each other to tighten the at least one ring-shaped first portion around the frustoconical body of the male terminal with elimination of the predetermined radial clearance; and at least one first element hinged to the at least one ring-shaped first portion of the clamp on a side from which the at least one first element is inserted upon the frustoconical body of the male terminal;

wherein the at least one first element is made of electrically non-conductive material and has a through-hole with a second diameter such that, when the clamp is fitted upon the male terminal, the through-hole establishes radial interference with the frustoconical body of the male terminal at the greatest diameter of the male terminal proximate to the base surface from which the male terminal projects, wherein the clamp further comprises:

a ring-shaped second portion with an open section of its circumference, the ring-shaped second portion lying over the at least one ring-shaped first portion and having a third diameter such that the predetermined radial clearance exists when the at least one ring-shaped first portion and the ring-shaped second portion are axially fitted to the frustoconical body, the ring-shaped second portion of the clamp further having two second jaws that radially project out of the ring-shaped second portion and are located at ends of the open section of the circumference of the ring-shaped second portion, the second jaws being in opposed, spaced-apart relationship and lying over the first jaws of the at least one ring-shaped first portion; and wherein the clamping device is configured to act on the first jaws of the at least one ring-shaped first portion and on the second jaws of the ring-shaped second portion of the clamp, is configured to move the first jaws of the at least one ring-shaped first portion toward each other to tighten the at least one ring-shaped first portion around the frustoconical body of the male terminal, and is configured to move the second jaws of the ring-shaped second portion toward each other to tighten the ring-shaped second portion around the frustoconical body of the male terminal, with elimination of the predetermined radial clearance.

6. The clamp of claim 1, wherein when fitting the clamp on the male terminal, the at least one first element, made of the electrically non-conductive material, prevents temporary electrical contact between the male terminal and the clamp before a correct position of the clamp on the male terminal has been reached.

7. The clamp of claim 1, wherein when fitting the clamp on the male terminal, the at least one first element, made of the electrically non-conductive material, prevents power supply from the power source via the male terminal and the clamp before a correct position of the clamp on the male terminal has been reached.

8. The clamp of claim 1, further comprising:

a second element associated with the at least one ring-shaped first portion of the clamp;

wherein the second element is made of electrically non-conductive material.

9. The clamp of claim 1, wherein the electrically non-conductive material is plastic.

10. The clamp of claim 5, wherein the first and second jaws are interconnected.

11. The clamp of claim 5, wherein the at least one ring-shaped first portion is connected to the ring-shaped second portion.

12. The clamp of claim 5, wherein the at least one first element, made of the electrically non-conductive material, is connected to the at least one ring-shaped first portion of the clamp such that the at least one first element is angularly movable relative to the at least one ring-shaped first portion.

13. The clamp of claim 5, wherein the electrically non-conductive material is plastic.

14. The clamp of claim 5, wherein when fitting the clamp on the male terminal, the at least one first element, made of the electrically non-conductive material, prevents temporary electrical contact between the male terminal and the clamp before a correct position of the clamp on the male terminal has been reached.

15. The clamp of claim 5, wherein when fitting the clamp on the male terminal, the at least one first element, made of the electrically non-conductive material, prevents power supply from the power source via the male terminal and the clamp before a correct position of the clamp on the male terminal has been reached.

16. A clamp for a male terminal of a power source, the male terminal consisting of a frustoconical body projecting out of a base surface that is part of the power source against which a greatest diameter of the male terminal rests, the clamp comprising:

at least one ring-shaped first portion, with an open section of its circumference, the at least one ring-shaped first portion having a first diameter such that a predetermined radial clearance exists when the at least one ring-shaped first portion axially fits upon the frustoconical body, the at least one ring-shaped first portion also having two first jaws which axially project out of the circumference of the at least one ring-shaped first portion and are located at ends of the open section of the circumference of the at least one ring-shaped first portion, the first jaws being in opposed, spaced-apart relationship;

a clamping device which acts on the first jaws and is configured to move the first jaws toward each other to tighten the at least one ring-shaped first portion around the frustoconical body of the male terminal with elimination of the predetermined radial clearance; and at least one first element hinged to the at least one ring-shaped first portion of the clamp on a side from which the at least one first element is inserted upon the frustoconical body of the male terminal;

wherein the at least one first element is made of electrically non-conductive material and has a through-hole with a second diameter such that, when the clamp is fitted upon the male terminal, the through-hole establishes radial interference with the frustoconical body of the male terminal at the greatest diameter of the male terminal proximate to the base surface from which the male terminal projects, and wherein the clamp further comprises:

a power cord for connecting the power source to a power consuming unit, the least one ring-shaped first portion of the clamp being connected to one end of the power cord;

a conductive basement protruding from the at least one ring-shaped first portion; and a conductive connecting screw protruding from the conductive basement, the one end of the power cord comprising an eyelet insertable upon the conductive connecting screw.

17. The clamp of claim 16, wherein the at least one first element, made of the electrically non-conductive material, is connected to the at least one ring-shaped first portion of the clamp such that the at least one first element is angularly movable relative to the at least one ring-shaped first portion.

18. The clamp of claim 16, wherein the electrically non-conductive material is plastic.

19. The clamp of claim 16, wherein when fitting the clamp on the male terminal, the at least one first element, made of the electrically non-conductive material, prevents temporary electrical contact between the male terminal and the clamp before a correct position of the clamp on the male terminal has been reached.

20. The clamp of claim 16, wherein when fitting the clamp on the male terminal, the at least one first element, made of the electrically non-conductive material, prevents power supply from the power source via the male terminal and the clamp before a correct position of the clamp on the male terminal has been reached.

* * * * *